United States Patent [19]

Keeling

[11] Patent Number: 4,748,881

[45] Date of Patent: Jun. 7, 1988

[54] ROLL SLICING MACHINE

[75] Inventor: Brian T. Keeling, Ferntree Gully, Australia

[73] Assignee: B. J. Mackie & Co. (Aust.) Pty. Ltd., Knoxfield, Australia

[21] Appl. No.: 32,181

[22] Filed: Mar. 30, 1987

[30] Foreign Application Priority Data

Apr. 2, 1986 [AU] Australia ..... PH5286

[51] Int. Cl.[4] ..... B26D 1/18; B26D 3/16

[52] U.S. Cl. ..... 82/49; 82/83; 82/92; 82/93; 82/DIG. 6

[58] Field of Search ..... 82/46, 49, 83, 86, 90, 82/92, 93

[56] References Cited

U.S. PATENT DOCUMENTS

| | | | |
|---|---|---|---|
| 1,685,127 | 9/1928 | Hammond et al. | 82/86 |
| 1,952,209 | 3/1934 | Judelshon | 82/86 |
| 2,365,760 | 12/1944 | Howlett | 82/90 |
| 3,161,097 | 12/1964 | Judelson | 82/86 |
| 3,861,253 | 1/1975 | Witcraft et al. | 82/83 |
| 3,933,063 | 1/1976 | Stoffels | 82/92 |

*Primary Examiner*—Frederick R. Schmidt
*Assistant Examiner*—William E. Terrell
*Attorney, Agent, or Firm*—Hovey, Williams, Timmons & Collins

[57] ABSTRACT

A machine for cutting slices from a cylinder of material. The machine has a machine frame with a holding assembly thereon for holding a cylinder of material for cutting and rotating the material cylinder about a central longitudinal axis. A disc shaped rotatable cutting blade is carried by the carriage assembly and drive means rotates the cutting blade. A carriage assembly is mounted on the frame for movement to present the rotating cutting blade to the rotating material cylinder for cutting the cylinder transversely into material slices. A brake mechanism is actuable to positively brake gripping chuck rotation upon cessation of the gripping chuck drive means operation. Moreover, a separate brake mechanism is operable to positively brake cutting blade rotation upon cessation of the cutting blade drive means operation. This braking prevents free running of the gripping chuck, material cylinder and cutting blade.

17 Claims, 2 Drawing Sheets

ROLL SLICING MACHINE

INTRODUCTION

This invention relates generally to a machine for accurately and cleanly cutting material, and in particular to such a machine for cutting axial sections or slices from a cylinder, such as a roll or log, of material. The machine is applicable for cutting slices from rolls of sheet material, such as pressure sensitive material, paper, textile, film, foam, and sponge, and it will be convenient to hereinafter describe the invention in relation to that exemplary application. It is to be appreciated, however, that the invention is not limited to that application.

BACKGROUND TO THE INVENTION

Sheet material, such as pressure sensitive material, is conveniently and economically produced in rolls which are often much longer than the width of pressure sensitive material usually required for use. Then, slices of desired thickness are cut from the material roll, with each providing a roll of pressure sensitive tape having a required width. This procedure minimises the range of material roll lengths that need to be produced to satisfy customer requirements, since the material roll can be cut into slices of desired width upon demand.

A range of machines have been developed for cutting these rolls of material, and in general they can provide satisfactory slices. However, it has been found that, in general, those machines are quite complex in construction and operation. Because of this they can be expensive to purchase and also to maintain.

Moreover, at least some of these machines are not fully automated in their cutting operation, so that a human operator is required to control and monitor the machine during that operation. This can be tedious for the human operator and lead to errors or inaccuracies in cutting material rolls or logs into slices. In addition, it may well add to machine operating costs.

OBJECT OF THE INVENTION

It is an object of the present invention to alleviate these disadvantages through the provision of a relatively simple cutting machine for slicing cylinders of material.

SUMMARY OF THE INVENTION

With that object in mind, the present invention broadly provides a machine for cutting slices from a cylinder of material, including: a machine frame; a holding assembly on the frame for holding a cylinder of material for cutting and rotating the material cylinder about a central longitudinal axis, the holding asembly including a gripping chuck rotatably mounted on the machine frame and arranged to releasably grip the material cylinder at one end thereof; a carriage assembly mounted on the machine frame for movement relative thereto; and, a disc shaped rotatable cutting blade carried by the carriage assembly, the carriage assembly being movable to present the rotating cutting blade to the material cylinder being held and rotated by the holding assembly for cutting the cylinder transversely of the longitudinal axis into material slices.

The invention is described herein with reference to the machine in a normal use orientation on a horizontal foundation, and the description should be read in the light of this orientation. However, it is to be appreciated that other machine orientations may be equally possible with consequential changes in the reading of the specification being necessary for a proper and complete understanding of the invention.

The machine frame is preferably of a rigid chassis type construction, suitable for standing on a foundation such as a solid floor.

The holding assembly preferably holds a cylinder of material so that its longitudinal axis extends generally horizontally.

Preferably, the holding assembly includes a mandrel by which a cylinder of material is supported for rotation, in its horizontal orientation, by the gripping chuck. In particular, the cylinder is supported against vibration or deflection caused by either rotation of the cylinder or presentation of the cutting blade to the cylinder in a cutting action. The mandrel is preferably at least substantially stationary during machine use, i.e. the mandrel does not rotate with the chuck and gripped cylinder of material. The gripping chuck is preferably rotatably driveable by suitable drive means.

Preferably, the machine incorporates a brake mechanism actuable to positively brake gripping chuck rotation upon ceasation of the drive means operation. This prevents free running of the gripping chuck and material cylinder. The brake mechanism may comprise a disc brake having a disc mounted for rotation along with the gripping chuck, and a pair of opposed brake pads between which the disc is mounted, the brake pads being operable to clamp the disc therebetween to brake disc rotation upon ceasation of drive means operation.

Preferably, the machine also incorporates drive means operable to rotate the cutting blade. A separate brake mechanism is preferably provided and operable to positively brake cutting blade rotation upon ceasation of the cutting blade drive means operation. This prevents free running of the cutting blade. This brake mechanism may also be actuable during operation of that drive means so as to apply a positive drag effect to the cutting blade. That brake mechanism may also comprise a disc brake having a disc mounted for rotation along with the cutting blade, and a pair of opposed brake pads between which the disc is mounted, the brake pads being operable to clamp the disc therebetween to brake disc rotation.

Preferably, the gripping chuck includes a main drive gear, and a plurality of pinion gears each engaging the main drive gear and being rotatably driven thereby. In addition, preferably a series of toothed racks each engage a respective pinion gear and are longitudinally movable radially of the central longitudinal axis in response to rotation of the pinion gears. These toothed racks act as jaws between which the one end of the material cylinder is gripped. The chuck preferably also includes a further pinion gear engaging the main drive gear and rotatable to rotate the main drive gear.

DESCRIPTION OF PREFERRED EMBODIMENT

The following description refers to a preferred embodiment of the machine of the present invention. To facilitate an understanding of the invention, reference is made in the description to the accompanying drawings where the machine is illustrated. It is to be understood that the invention is not limited to the embodiment as hereinafter described and as illustrated.

Figure 1:
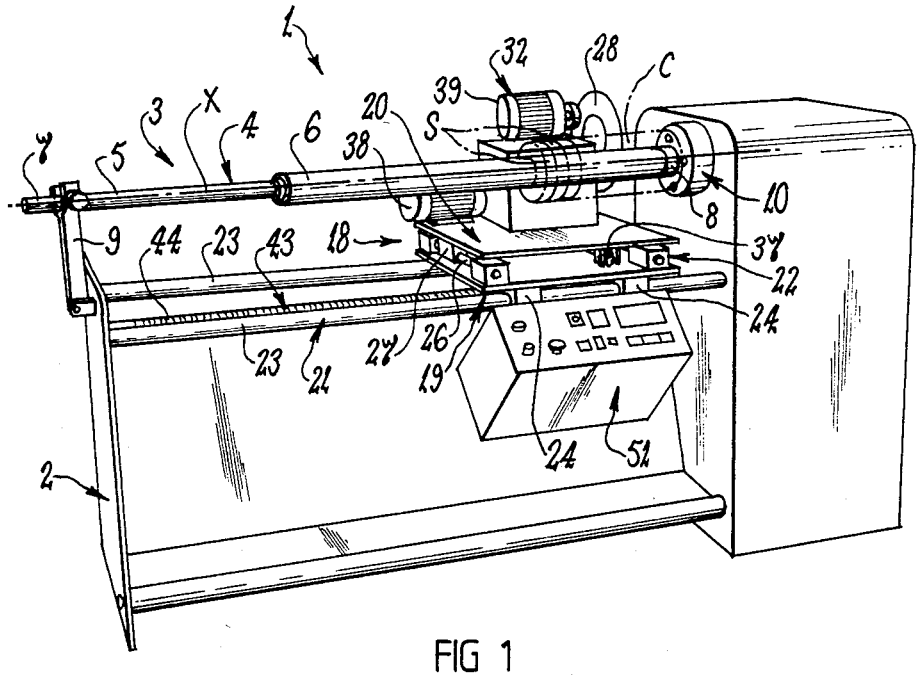
FIG. 1 is a perspective view of a preferred embodiment of the machine of the present invention.
Figure 2:
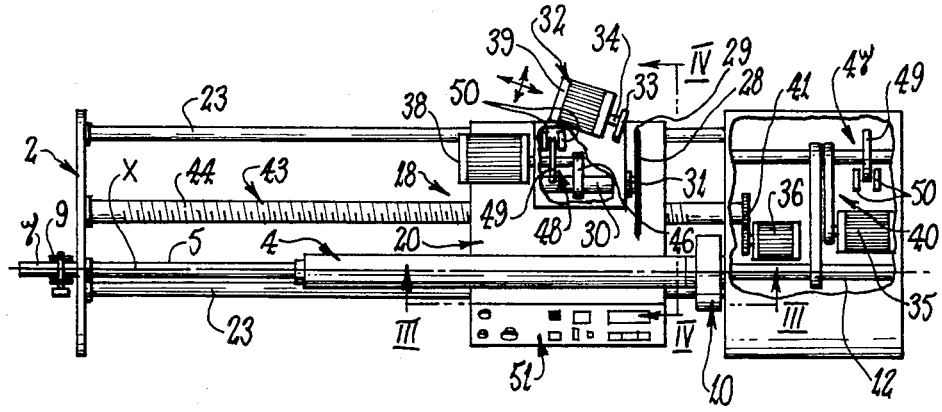
FIG. 2 is a top plan view of the machine of FIG. 1, partially cut away.

Referring initially to FIGS. 1 and 2 of the drawings there is generally illustrated machine 1, for cutting a cylinder of material C, into a series of axial slices S. Typically, cylinder C, will comprise an annular log or roll of sheet material such as presssure sensitive adhesive material.

Machine 1, includes frame 2, of a solid construction formed from cast metal and/or fabricated from suitable heavy gauge metal stock material. Frame 2, is so constructed as to minimise distortions which would otherwise inevitably lead to inaccuracies in material cutting during use of machine 1.

Mounted on frame 2, is holding assembly 3, by which material cylinder C, is held for rotation about central longitudinal axis X. Assembly 3, includes a support mandrel 4, on which cylinder C, is carried. Mandrel 4, is shaped and sized relative to a central passage of cylinder C, so that cylinder C, is a close sliding fit thereon. Mandrel 4, may be circular in cross-sectional shape, and the central passage may be similarly shaped.

Mandrel 4, is of a generally rigid construction, although may have a soft protective outer surface layer that may be cut during cutting of cylinder C, without damaging machine components. To that end, mandrel 4, typically includes rigid steel core 5, with soft outer sleeve 6. Sleeve 6, may replaceable as necessary.

Mandrel 4, is mounted for rigid support adjacent each end 7,8, of cylinder C, carried thereon. To that end, holding assembly 3, also includes support arm 9, arranged to support mandrel 4, at end 7. Support arm 9, is mounted on machine frame 2, and connects to core 5, of mandrel 4, for support thereof. Although not illustrated support arm 9, movably so mounted to allow its movement along mandrel 4, may be so as to accommodate different length material cylinders C, on mandrel 4. Support arm 9, is also disconnectable from mandrel 4, for sliding material cylinders C, thereon and removing material slices S, therefrom.

Other end 8, of mandrel 4, is supported by gripping chuck 10, included within holding assembly 3. Support of mandrel 4, by chuck 10, is permanent so that mandrel 4, is not removed during placement of material cylinder C, or removal of material slices S. End 8, of mandrel 4, is supported centrally within chuck 10, in a manner which maintains mandrel 4, stationary but allows movement of chuck 10, to rotate cylinder C.

Figure 5:
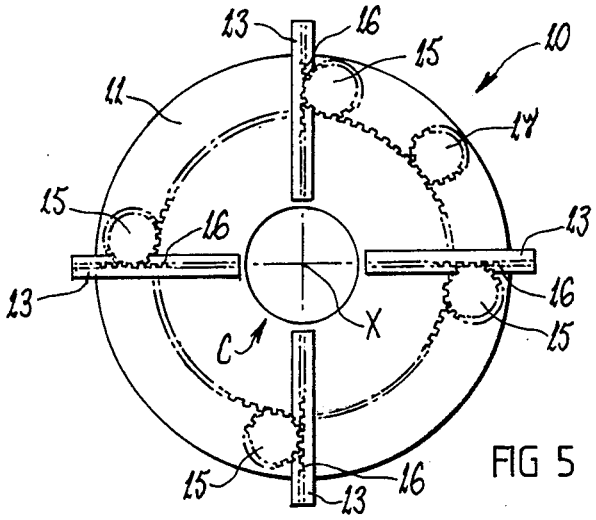
FIG. 5 is a front view of the gripping chuck of the machine of FIG. 1.

Gripping chuck 10, shown in more detail in FIG. 5, includes chuck body 11, rotatably mounted on machine frame 2, through support spindle 12. End 8, of mandrel 4, supported within chuck 10, is journalled concentrically within chuck body 11, and/or support spindle 12, so that chuck body 11, rotates thereabout.

Gripping chuck 10, is arranged to releasably grip material cylinder C, at one end for rotation therewith. To that end, chuck 10, also includes a plurality (such as four) of gripping jaws 13, carried by body 11, and between which the cylinder end is gripped, jaws 13, being movable to release and grip the cylinder end. Jaws 13, may be arranged to project over the cylinder end and engage an outer cylinder surface to grip the end thereabout.

Gripping jaws 13, are mounted for sliding linear movement in a radial direction relative to central longitudinal axis X, to clamp and release cylinder C. That movement is achieved by means of toothed main drive gear 14, mounted in body 11, for rotation about longitudinal axis X and a series of toothed pinion gears 15, each also rotatably mounted on body 11, so as to mesh with drive gear 14. Each pinion gear 15, is associated with a respective jaw 13, which incorporates rack 16, meshing with respective jaw 13. In this way, rotation of main drive gear 14, simultaneously rotates each pinion gear 15, which in turn simultaneously linearly moves all of jaws 13. Rotation of main drive gear 14, is achieved through further pinion gear 17, rotatably mounted on body 11, and meshing with drive gear 14. Pinion gear 17, is manually rotatable to effect movement of main drive gear 14.

Figure 3:
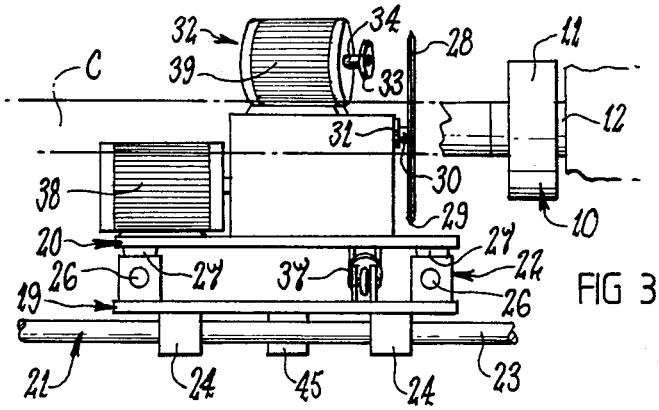
FIG. 3 is a view from line III—III of part of the machine of FIG. 2.
Figure 4:
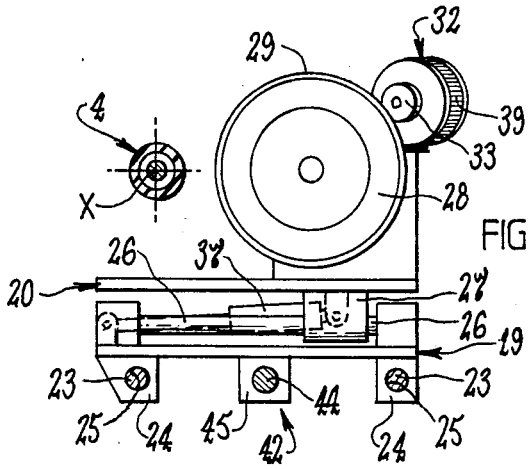
FIG. 4 is a view from line IV—IV of part of the machine of FIG. 2.

Machine 1, also includes carriage assembly 18, mounted on frame 2, for movement relative thereto. Carriage assembly 18, is shown in more detail in FIGS. 3 and 4, and includes a pair of carriage frame parts 19,20, each being linearly movable in respective relatively perpendicular axes. In particular, the frame part arrangement is such that frame part 19, has frame part 20, mounted thereon, movement of frame part 19, causing frame part 20, to move therewith parallel to central longitudinal axis X, and movement of frame part 20, is relative to frame part 19, perpendicular toward and away from axis X.

Carriage assembly frame parts 19,20, are of generally solid construction and may be formed from cast metal and/or fabricated from suitable metal stock.

Carriage frame parts 19,20, are each constrained by separate respective support guides 21,22, to move within a single respective horizontal plane. Support guide 21, includes a pair of rigid rod-like guide rails 23, along which frame part 19, moves. Rails 23, are fixed on machine frame 2, in parallel spaced apart relationship. Support guide 21, also includes a series of slide blocks 24, on which frame part 19, is mounted and which slide along rails 23, resulting in movement of frame part 19. A pair of such blocks 24, may be associated with each rail 23, blocks 24, of each rail 23, being arranged in spaced apart relationship along the respective rail 23. Slide blocks 24, each have bore 25, therethrough for receiving respective guide rail 23, in journalled sliding engagement.

Support guide 22, for frame part 20, movable mounts frame part 20, on frame part 19, in the same manner as frame part 19, is mounted on machine frame 2. In this case, however, guide rails 26, are mounted on frame part 19, so as to extend perpendicular to those mounting frame part 19, onto machine frame 2. Blocks 27, are mounted on frame part 20 and have rails 26, journalled therein.

Carried on frame part 20, is rotatable cutting blade 28. Blade 28, is disc shaped with circumferential sharp cutting edge 29. Cutting edge 29, may be smooth and unserrated, or may be otherwise profiled as determined by the material to be cut. Blade 28, is mounted on drive spindle 30, which in turn is rotatably journalled in support bearing 31, mounted on frame part 20. Blade 28, is removably so mounted for replacement as necessary.

To reduce the necessity for removing cutting blade 28, at least for regular cutting edge sharpening, machine 1, may further include sharpening device 32, selectably operable to sharpen cutting edge 29, whilst blade 28 remains on drive spindle 30. Sharpening device 32, includes grinding wheel 33, rotatable to grind sharp cutting edge 29. Wheel 33, may be selectively movable into grinding engagement with cutting edge 29, simultaneous rotation of both grinding wheel 33, and cutting blade 28, causing grinding of cutting edge 29. Wheel 33, is mounted for movement toward and away from cutting blade 28. Wheel 33, may also be movable for varying the angle of the wheel axis of rotation relative to the blade axis of rotation, to adjust the grinding angle between grinding wheel 33, and blade 28, and thereby set the cutting angle of blade 28. Grinding wheel 33, is mounted on rotatable drive spindle 34, which in turn carries wheel 33, during its movement relative to cutting blade 28.

Sharpening devices 32, is mounted (directly or indirectly) on carriage assembly frame part 20, for its movement toward and away from cutting blade 28. Conveniently, movement is such that device 32, is capable of sharpening cutting blade 28, at any location of carriage assembly 18, along mandrel 4.

Machine 1, further includes separate drive motors 35,36,37,38, to respectively rotate gripping chuck 10, slide carriage assembly frame part 19, slide carriage assembly frame part 20, and rotate cutting blade 28. Further drive motor 39, is provided to rotate grinding wheel 33, where sharpening device 32, is included in machine 1. Each motor 35 to 39 may be a rotary output electric motor, although other motors may be equally applicable and specifically in that regard, motor 37, for carriage assembly frame part 20, may be a linear output, hydraulic or pneumatic piston-and-cylinder actuator (as illustrated).

Motors 35 to 39 may be directly coupled to their respective machine components being driven. More likely, however, that coupling will be through suitable drive transmissions. These transmissions enable conversion of the drive motor outputs to a more appropriate input to the machine components being driven. The transmissions also may allow selective engagement and disengagement between the drive motor outputs and machine component inputs, such as through clutches or the like.

Rotary output electric drive motor 35, for gripping chuck 10, may be coupled to chuck support spindle 12, through a belt and pulley transmission 40, (as illustrated) or gear train or chain transmission (not illustrated). Drive motor 35, and transmission 40, may be mounted within machine frame 2.

Rotary output electric drive motor 36, for carrier assembly frame part 19, may be coupled thereto through gear train 41, (as illustrated) or belt and pulley or chain transmission (not illustrated) as well as translation transmission 42, converting rotary drive output to linear drive input to frame part 19, for sliding movement thereof. That translation transmission 42, shown in FIGS. 2 and 4 includes transversing screw 43, having rotatable screw threaded shaft 44, mounted on machine frame 2, for rotation about its longitudinal axis, and shaft follower 45, mounted on frame part 19, which engage screw threaded shaft 44. Shaft follower 45, includes tracking balls (not illustrated) that track along shaft 44, in response to shaft rotation and cause frame part 19, to linearly slide along guide rails 23. Drive motor 36, and transmissions 41,42, are generally mounted on machine frame 2, although translation transmission 42, will also be connected to carriage assembly 18.

Rotary output electric drive motor 38, for cutting blade 28, is coupled to drive spindle 30, through a belt and pulley transmission 46 (as illustrated) or gear train or chain transmission (not illustrated). Motor 38, and transmission 46, may be mounted on frame part 20.

Linear output piston-and-cylinder drive motor 37, for frame part 20, is mounted directly between frame parts 19,20, i.e. the piston may be connected to frame part 19, whilst the cylinder is connected to frame part 20, so that movement therebetween causes frame part 20, to slide on guide rails 26.

To facilitate control of the driven machine components, and in particular to prevent their continued movement or "running on" once driving has ceased, machine 1, also includes brake mechanisms 47,48, actuable to positively stop machine component movement, and in particular, stop rotation of gripping chuck 10, and cutting blade 28, respectively. Mechanism 47, is arranged so as to act on transmission 40, connected to gripping chuck support spindle 12, and mechanism 48, on the output shaft of drive motor 38, for cutting blade 28. Each mechanism 47,48, conveniently comprises a disc brake of conventional construction including separate disc 49, mounted for rotation when gripping chuck 10, and cutting blade 28, rotate and mounted between a pair of opposing brake pads 50, operable to clamp respective disc 49, therebetween to stop its rotation and also rotation of the corresponding gripping chuck 10, or cutting blade 28.

In addition to stopping machine component rotation, brake mechanisms 47,48, may be actuable to control the speed of rotation of those components by varying the clamping force supplied to the discs 49, by brake pads 50. That may be particularly so with mechanism 48, associated with cutting blade 28, where mechanism 48, may be used to produce a drag effect on blade 28, against the drive applied by motor 38. That may facilitate cutting some materials.

Drive motor operation is at least substantially automatic. In that regard, drive motors 35 to 39 operate in response to operating signals supplied by an electrical control system 51, (illustrated only generally) that can be preset to achieve a desired slicing of cylinder C. Control system 51, is constructed and arranged to provide a logical functional sequence of machine components during machine use. In particular, system 51, will control the operation of drive motors 35 to 39 and brake mechanism 47,48, and so control the functions performed by their relative components. That control, is in the sense of both duration of each operation and timing of each operation relative to each other operation and other machine component functions. In this way, system 51, will allow machine 1, to automatically cut given material cylinders C into a predetermined number or size of slices S.

In using this preferred embodiment of machine 1, material cylinder C, is slid onto mandrel 4, and moved therealong until one end can be gripped between jaws 13. Support arm 9, will have been disconnected from mandrel 4, to achieve that mounting and arm 9, is then reconnected. Thus, cylinder C, is firmly supported between gripping chuck 10, and support arm 9.

Cutting of cylinder C, commences at the end nearer support arm 9, with successive cuts proceeding along cylinder C, toward chuck 10. Carriage assembly 18, is moved to shift cutting blade 28, into each successive cutting location. That is achieved by initially moving frame part 19, along guide rails 23, while frame part 20, retains cutting blade 28, retracted away from cylinder C. Movement of frame part 19, continues until blade 28, lies in a plane containing the location at which a cut is to be made. Frame part 20, is then moved to forward shift cutting blade 28, into cutting engagement with cylinder C. During this approach cylinder C, and cutting blade 28, are rotating so that engagement therebetween will cause material cutting. That cutting continues until cutting blade 28, reaches soft outer sleeve 6, of mandrel 4, and so cuts material slice S, from cylinder C.

Frame part 20, is then reverse moved so as to retract cutting blade 28, away from mandrel 4. Frame part 19, can then again be moved along guide rails 23, toward gripping chuck 10, to shift cutting blade 28, to its next cutting location. The length of movement of frame part 19, will in effect determine the width of slices S, and that may be preset and so determined by electrical control system 51, during machine use. Control system 51, may also conveniently count the number of slices S, cut and provide a record of that for accounting purposes.

Following slicing of cylinder C, cutting blade 28, is retracted from mandrel 4, and chuck rotation ceased prior to removal of the material slices S. That will again entail disconnection of support arm 9, from mandrel 4, and slipping each slice S, therefrom.

A machine according to the present invention is of a relatively simple construction and operation. As such, the cost of purchase of the machine may be less than those of present comparable machines. In addition, the cost of maintaining the machine may be minimal.

Operation of the machine is substantially automatic, at least in a preferred embodiment, and that may reduce errors or inaccuracies in cutting material cylinders into slices. Since only nominal operator monitoring is required, operating costs of the machine may be minimal.

It should be appreciated that various modifications and/or alterations may be made to the machine without departing from the ambit of the present invention defined in the claims hereto.

I claim:

1. A machine for cutting slices from a cylinder of material, including: machine frame; a holding assembly on the frame for holding a cylinder of material for cutting and rotating the material cylinder about a central longitudinal axis; the holding assembly including a gripping chuck rotatably mounted on the machine frame and arranged to releasably grip the material cylinder at one end thereof; drive means operable to rotate the gripping chuck; a carriage assembly mounted on the machine frame for movement relative thereto; a disc shaped rotatable cutting blade carried by the carriage assembly; drive means operable to rotate the cutting blade; the carriage assembly being movable to present the rotating cutting blade to the material cylinder being held and rotated by the gripping chuck for cutting the cylinder transversely of the longitudinal axis into material slices; a brake mechanism actuable to positively brake gripping chuck rotation upon cessation of the gripping chuck drive means operation and thereby prevent free running of the gripping chuck and material cylinder; and a separate brake mechanism operable to positively brake cutting blade rotation upon cessation of the cutting blade drive means operation and thereby prevent free running of the cutting blade, the brake mechanism for the cutting blade also being operable during operation of the drive means rotating the cutter blade so as to apply a positive drag effect to the rotating cutter blade.

2. A machine as claimed in claim 1, wherein the brake mechanism for the gripping chuck comprises a disc brake including a disc mounted for rotation along with the gripping chuck, and a pair of opposed brake pads between which the disc is mounted, the brake pads being operable to clamp the disc therebetween to brake disc rotation upon ceasation of the gripping chuck drive means operation.

3. A machine as claimed in claim 2, wherein the holding assembly includes a support spindle rotatably journalled on the machine and on which the gripping chuck is rigidly mounted for rotation therewith, and the disc of the gripping chuck brake mechanism is rigidly mounted on the support spindle for rotation therewith.

4. A machine as claimed in claim 1, wherein the brake mechanism for the cutting blade comprises a disc brake including a disc mounted for rotation along with the cutting blade, and a pair of opposed brake pads between which the disc is mounted, the brake pads being operable to clamp the disc therebetween to brake disc rotation.

5. A machine as claimed in claim 4, wherein the drive means for the cutting blade includes a drive motor having a rotatable drive shaft and the disc of the cutting blade brake mechanism is rigidly mounted on the drive shaft for rotation therewith.

6. A machine as claimed in claim 1, wherein, the gripping chuck includes a main drive gear, a plurality of pinion gears each engaging the main drive gear and being rotatably driven thereby, and a series of toothed racks each engaging a respective pinion gear and longitudinally movable radially of the central longitudinal axis in response to rotation of the pinion gears, the toothed racks acting as jaws between which the one end of the material cylinder is gripped, the chuck also including a further pinion gear engaging the main drive gear and rotatable to rotate the main drive gear.

7. A machine as claimed in claim 1, wherein the carriage assembly includes a carriage frame having a pair of carriage frame parts, a pair of longitudinal guide rails fixed on the machine frame parallel to the central longitudinal axis with one carriage frame part being mounted on the longitudinal guide rails for movement therealong, and a pair of transverse guide rails fixed on the one carriage frame part transverse to the central longitudinal axis with the other carriage frame part mounted on the transverse guide rails for movement therealong, and the cutting member is mounted on the other carriage frame part for movement therewith, whereby movement of the one and other carriage frame parts moves the cutting blade respectively along and transversely of, the material cylinder held by the holding assembly.

8. A machine as claimed in claim 7, wherein the longitudinal and transverse guide rails are cylindrical rod shaped, and each of the one and other carriage frame parts includes spaced apart guide blocks each having a bore therethrough for receiving a guide rail in sliding engagement therewith.

9. A machine as claimed in claim 7, and further including drive means operable for independently moving the one and other carriage frame parts, the drive means including a transversing screw having a rotatable screwthreaded shaft mounted on the machine frame for rotation about its longitudinal axis and a shaft follower mounted on the one carriage frame part and having tracking balls engaging the screwthreaded shaft and tracking along the shaft in response to shaft rotation, and thereby causing movement of the one carriage frame part.

10. A machine as claimed in claim 9, wherein the drive means also includes a piston-and-cylinder actuator operable for moving the other carriage frame part along the transverse guide rails.

11. A machine as claimed in claim 1, and further including a grinder having a grinding wheel for sharpening the cutting blade, the grinder being mounted on the carriage assembly along with the cutting blade and also movable relative to the cutting blade to bring the grinding wheel into grinding engagement with the cutting blade, the grinding wheel being engageable with the cutting blade at any position to which the cutting blade is moved by the carriage assembly.

12. A machine for cutting slices from a cylinder of material, including: a machine frame, a holding assembly on the frame for holding a cylinder of material for cutting and rotating the material cylinder about a central longitudinal axis, the holding assembly including a gripping chuck rotatably mounted on the machine frame and arranged to releasably grip the material cylinder at one end thereof; a carriage assembly mounted on the machine frame for movement relative thereto; a disc shaped rotatable cutting blade carried by the carriage assembly, drive means operable to rotate the cutting blade; the carraige assembly being movable to present the rotating cutting blade to the material cylinder being held and rotated by the holding assembly for cutting the cylinder transversely of the longitudinal axis into material slices; and a brake mechanism operable to positively brake cutting blade rotation upon ce ssation of the cutting blade drive means operation following cylinder cutting and thereby prevent free running of the cutting blade, the brake mechanism for the cutting blade also being operable during operation of the drive means rotating the cutter blade so as to apply a positive drag effect to the rotating cutter blade.

13. A machine as claimed in claim 12, wherein the brake mechanism for the cutting blade comprises a disc brake including a disc mounted for rotation along with the cutting blade, and a pair of opposed brake pads between which the disc is mounted, the brake pads being operable to clamp the disc therebetween to brake disc rotation.

14. A machine as claimed in claim 13, wherein the drive means for the cutting blade includes a drive motor having a rotatable drive shaft and the disc of the cutting blade brake mechanism is rigidly mounted on the drive shaft for rotation therewith.

15. A machine as claimed in claim 12, wherein, the gripping chuck includes a main drive gear, a plurality of pinion gears each engaging the main drive gear and being rotatably driven thereby, and a series of toothed racks each engaging a respective pinion gear and longitudinally movable radially of the central longitudinal axis in response to rotation of the pinion gears, the toothed racks acting as jaws between which the one end of the material cylinder is gripped, the chuck also including a further pinion gear engaging the main drive gear and rotatable to rotate the main drive gear.

16. A machine as claimed in claim 12, wherein the carriage assembly includes a carriage frame having a pair of carriage frame parts, a pair of longitudinal cylindrical rod shaped guide rails fixed on the machine frame parallel to the central longitudinal axis with one carriage frame part being mounted on the longitudinal guide rails for movement therealong, and a pair of transverse cylindrical rod shaped guide rails fixed on the one carriage frame part transverse to the central longitudinal axis with the other carriage frame part mounted on the transverse guide rails for movement therealong, and the cutting member is mounted on the other carriage frame part for movement therewith, whereby movement of the one and other carriage frame parts moves the cutting blade respectively along and transversely, of the material cylinder held by the holding assembly.

17. A machine as claimed in claim 12, and further including drive means operable for independently moving the one and other carriage frame parts, the drive means including a transversing screw having a rotatable screwthreaded shaft mounted on the machine frame for rotation about its longitudinal axis and a shaft follower mounted on the one carriage frame part and having tracking balls engaging the screwthreaded shaft and tracking along the shaft in response to shaft rotation, and thereby causing movement of the one carriage frame part, the drive means also including a piston-and-cylinder actuator operable for moving the other carriage frame part along the transverse guide rails.

* * * * *